US005429262A

United States Patent [19]

Sharkey

[11] Patent Number: 5,429,262

[45] Date of Patent: Jul. 4, 1995

[54] AUXILIARY CONDIMENT CONTAINER

[76] Inventor: Edgar R. Sharkey, 818 NW. 8th Ave., Dania, Fla. 33004

[21] Appl. No.: 267,041

[22] Filed: Jun. 27, 1994

Related U.S. Application Data

[63] Continuation-in-part of Ser. No. 955,840, Oct. 2, 1992, abandoned.

[51] Int. Cl.[6] ..... B65D 17/28

[52] U.S. Cl. ..... 220/23.83; 220/23.4

[58] Field of Search ..... 220/23.4, 23.83, 23.86, 220/356

[56] References Cited

U.S. PATENT DOCUMENTS

| | | | |
|---|---|---|---|
| 2,149,612 | 3/1939 | Madsen | 220/23.83 X |
| 2,556,439 | 6/1951 | Pearson | 220/23.83 X |
| 2,795,121 | 6/1957 | Pantello | 220/23.83 |
| 4,339,033 | 7/1982 | Cillario | 220/23.4 X |
| 4,491,220 | 1/1985 | Daviss | 220/23.4 X |
| 4,854,466 | 8/1989 | Lane, Jr. | 220/23.83 |
| 4,966,294 | 10/1990 | Mack et al. | 220/356 X |
| 5,297,695 | 3/1994 | Provence | 220/23.83 X |

*Primary Examiner*—Steven M. Pollard

*Attorney, Agent, or Firm*—Woodard, Emhardt, Naughton Moriarty & McNett

[57] ABSTRACT

A carry-along self-contained and supported container of catsup is provided with integral prongs for easy attachment to an associated foodstuff container of discrete french fries. In a most preferred embodiment, the condiment container includes a receptacle provided with an upper flange having a pair of downward opening prongs integrally formed thereon for engaging the french fry container in the throat of the clip. A lid is provided to snap over the flange an cover the opening of the condiment receptacle to seal the contents until it is desired to dip french fries into the condiment.

16 Claims, 3 Drawing Sheets

AUXILIARY CONDIMENT CONTAINER

REFERENCE TO RELATED CASES

This application is a continuation-in-part of U.S. application Ser. No. 07/955,840, filed on Oct. 2, 1992, now abandoned.

BACKGROUND OF THE INVENTION

The present invention relates to containers for edible products such as condiments which are generally used in association with other food products. More particularly, the present invention relates to an auxiliary condiment container that provides the convenience of handy availability of condiments, such as catsup, with foodstuff, such as french fries, in an associated container. Prior containers are known which effectively hold a supply of condiment separate from the associated foodstuff. However, such separate containers all have disadvantages nicely avoided by the present invention. For example, they are not attachable to the primary foodstuff container, and thus are not supportable with the primary container in a one-hand manner. In other arrangements the user would have to empty the entire contents of a condiment receptacle onto the primary foodstuff to avoid awkwardness of separately supporting the condiment receptacle, thus making it difficult to distribute the condiment evenly, or to eat pieces of the foodstuff without messiness.

Such prior receptacles fail to provide the present invention's advantages. There is needed an arrangement for providing full support of the condiment receptacle wholly from the primary foodstuff container without any structural modification of the primary container itself. There is a particular need in the fast-food industry for a condiment container which contains a separate supply of catsup and which has means for engaging the holder to a package of french fries.

SUMMARY OF THE INVENTION

In view of this need, the present invention contemplates an auxiliary condiment container that can be readily and easily secured to an associated foodstuff container. A typical foodstuff container is formed of a material, such as cardboard, that is crushable for ready disposal yet able to hold its shape.

In one embodiment of the invention, a condiment container includes receptacle having an upper flange about the top opening of the container. The upper flange is formed into a downward opening clip so that the edge of a foodstuff container can be engaged within the throat of the clip. In another aspect, the condiment container includes a removable cover over the opening of the container. The container includes a supply of catsup for use with a foodstuff container of french fries so that the user can remove the receptacle cover and dip each french fry into the catsup. The present invention thus provides means for readily associating a condiment container with a food container so that both components can be held in one hand, leaving the other hand free to dip food into the condiment.

In another embodiment of the invention, the receptacle of the condiment container is molded as a single piece with the upper flange integral with the container opening and with a pair of attachment prongs projecting from the underside of the flange. The upper flange adds rigidity and strength to the container. The pair of prongs provides adequate attachment to the foodstuff container while minimizing contact with the food therein. The condiment container of this embodiment is intended for reuse and is therefore provided with a separate lid that snaps onto the upper flange. Both container and lid are formed of a dishwasher safe material so that food providers or customers can clean and reuse the container.

It is one object of this invention to provide a condiment container that can be readily and removably associated with a foodstuff container. A further object resides in the provision of a condiment container and foodstuff container that can be held in one hand by the consumer, thereby freeing up the other hand to dip the food into the condiment.

Other objects and many benefits of the present invention can be gleaned from the following written description and accompanying figures.

DESCRIPTION OF THE PREFERRED EMBODIMENTS

Figure 1:
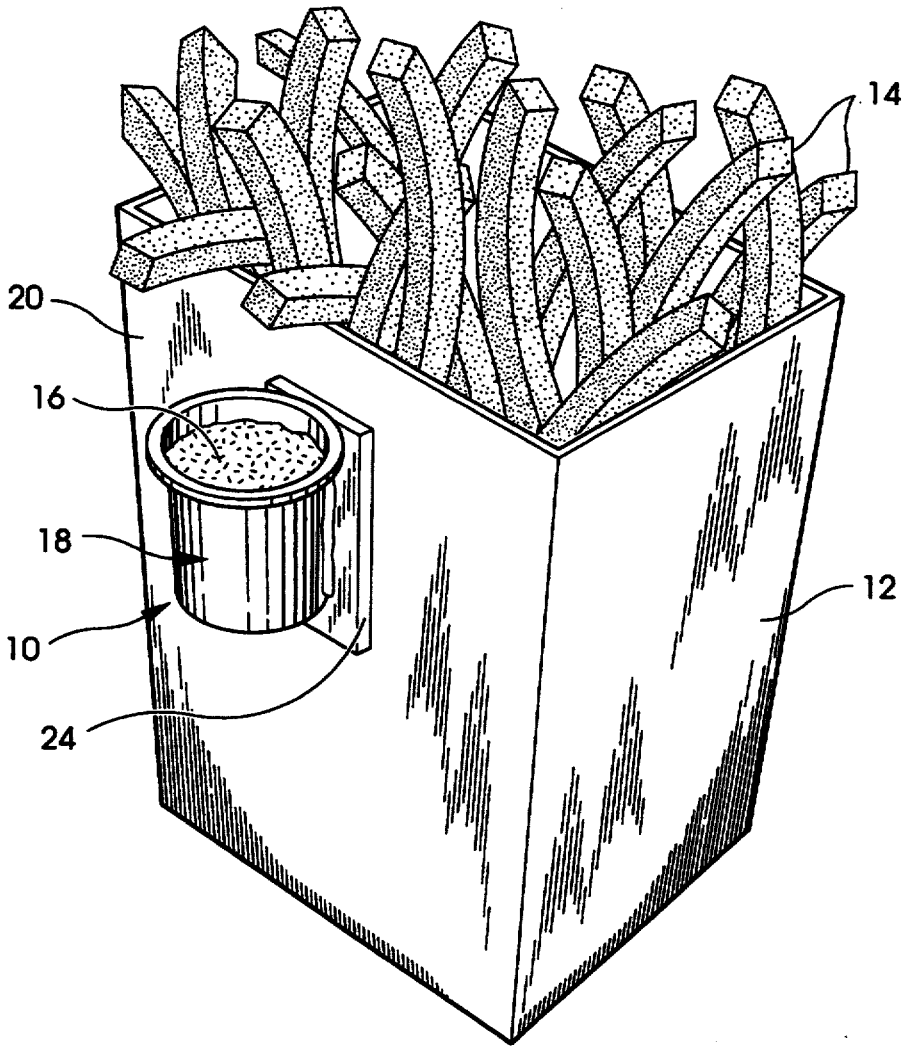
FIG. 1 is a pictorial view of one embodiment of the invention, showing a generally cylindrical holder or container of catsup mounted to a side wall of an associated container of a food product, here french fries.

For the purposes of promoting an understanding of the principles of the invention, reference will now be made to the embodiments illustrated in the drawings and specific language will be used to describe the same. It will nevertheless be understood that no limitation of the scope of the invention is thereby intended, such alterations and further modifications in the illustrated device, and such further applications of the principles of the invention as illustrated therein being contemplated as would normally occur to one skilled in the art to which the invention relates.

As shown in the drawings, the present invention provides an auxiliary condiment container 10 for use with an associated and self-supporting container 12 of foodstuff 14. The food container 12 is of the type commonly found at fast-food restaurants which is formed of cardboard or similar cellulosic material and which can be easily crushed for disposal. The foodstuff container 12 is typically sufficiently rigid to hold its own shape and to support a condiment container 10 engaged thereon. The foodstuff 14 can include strips of "french fry" potatoes, and the condiment 16 contained in the auxiliary device 10 can be catsup.

The condiment container 10 includes a receptacle 18 which is preferably of a proportionate size relative to the container 12 to hold a quantity of the catsup 16 generally considered suitable for the amount of french fries 14 in container 12. In one specific embodiment, the condiment receptacle 18 is sized to hold about a cubic inch of catsup 16 for a medium size container of french fries 14.

One important aspect of the invention resides in easy and convenient attachment of the condiment container 10 to the foodstuff container 12. One manner of attachment is achieved by securing means 24 provided on the receptacle 18 for mounting on a side wall 20 of the food container 12. Particularly, the securing means 24 has an adhesive outer surface 32 for attachment to the food container wall 20.

The condiment receptacle 18 is composed of a readily disposable material. One example is the cardboard or cellulosic material used in many french fry containers. The material could be corrugated to add strength and resistance to buckling. The cylindrical shape of the receptacle 18 also adds strength to the container.

Figure 2:
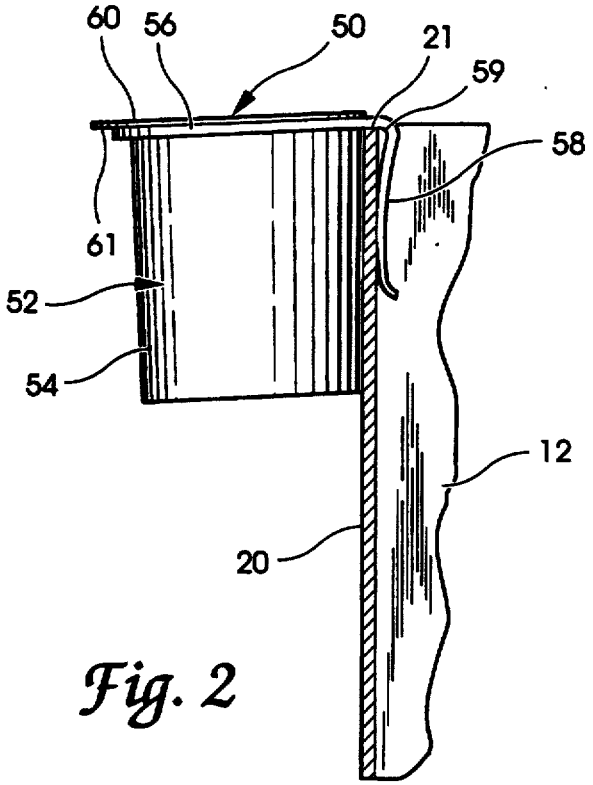
FIG. 2 is a side elevational view of another embodiment of the auxiliary condiment container of the present invention which employs a downward opening clip to engage the foodstuff container.

In a preferred embodiment of the present invention, an auxiliary condiment container 50, shown in FIG. 2, includes a condiment receptacle 52 which defines an enclosure to contain a supply of catsup or similar condiment. The receptacle 52 is formed by an outer wall 54 open at the top. An upper flange 56 is formed at the upper edge of the outer wall 54 at the receptacle opening. The flange 56 is contoured into a downward opening clip 58. The throat 59 of the clip is configured to be received over the upper edge 21 of the outer wall 20 of an associated food container 12. The clip 58 is formed of a resilient material and is contoured toward the condiment receptacle 52 so that the container outer wall 20 is firmly gripped between the clip 58 and the receptacle wall 54. This resilient material is preferably a plastic, such as polyethylene, having sufficient stiffness to perform the gripping function expected of the clip 58.

The upper flange 56 is likewise formed of the clip material and is sufficiently stiff to add structural integrity to the receptacle 52, even when the receptacle is formed of a cardboard-type material. The flange 56 can be adhered to the condiment receptacle 52 at the upper edge of the outer wall 54. Alternatively, the receptacle outer wall 54 can be flared at its upper edge to form the flange 56. In this instance, the clip 58 could be separately affixed to the flange 56 or the outer wall 54 of the condiment container.

The flange 56 provides a seating surface for a receptacle cover 60 removably adhered thereto. The cover 60 seals the contents of the receptacle until the receptacle is engaged to a food container 12. The cover 60 includes a tab 61 which extends beyond the flange 56 to facilitate removal of the cover.

The present invention provides an accommodation for the user of separate supplies of each of foodstuff and condiment, both being conveniently holdable by merely a single one of the customer's hands. Moreover, the condiment is always within immediate reach of the foodstuff, avoiding the messiness of having condiment on remaining portions of the foodstuff in the coat,her. This invention is particularly useful at a carry-out or fast-food restaurant. In such a setting, discrete food pieces, such as individual french fries, can be conveniently dipped into the condiment, such as catsup, contained in a receptacle 52 of this preferred embodiment. The auxiliary condiment container 50 is also readily disposable with the food or french fry container. While the preferred embodiment finds its possibly best use with french fries and catsup, it is contemplated that receptacles of other condiments, such as mustard, hot sauce, or honey, can be supported on containers of chicken strips, nacho chips, or other multiple discrete food pieces convenient for dipping into the condiment.

Figure 3:
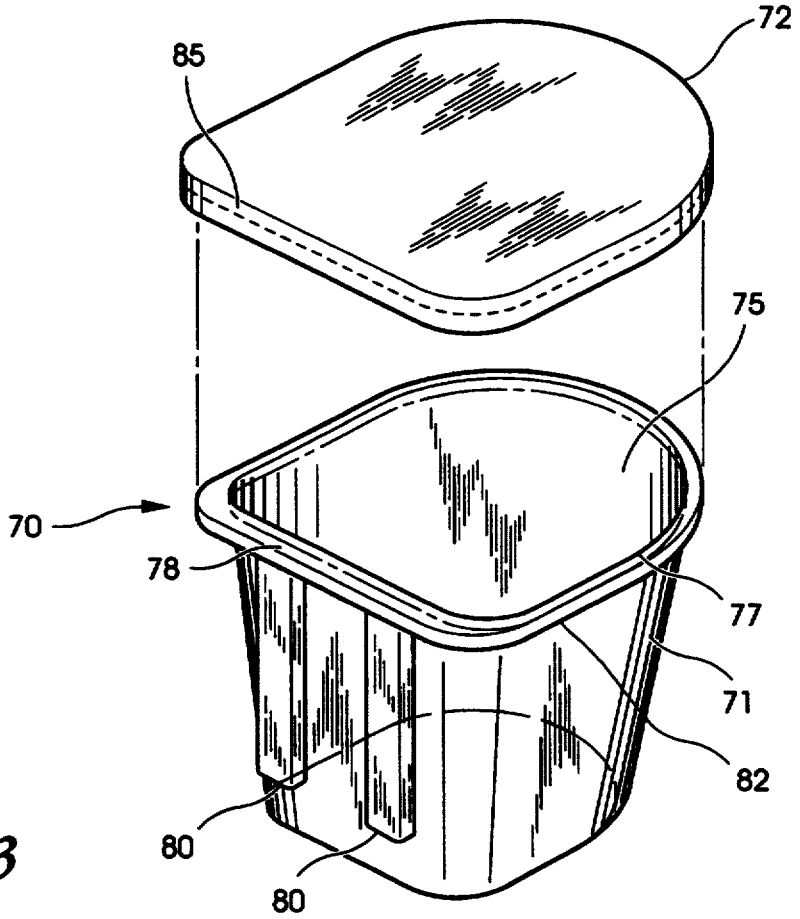
FIG. 3 is a pictorial view of a preferred embodiment of the auxiliary condiment container according to the present invention which employs downward opening prongs and a separately detachable lid.
Figure 4:
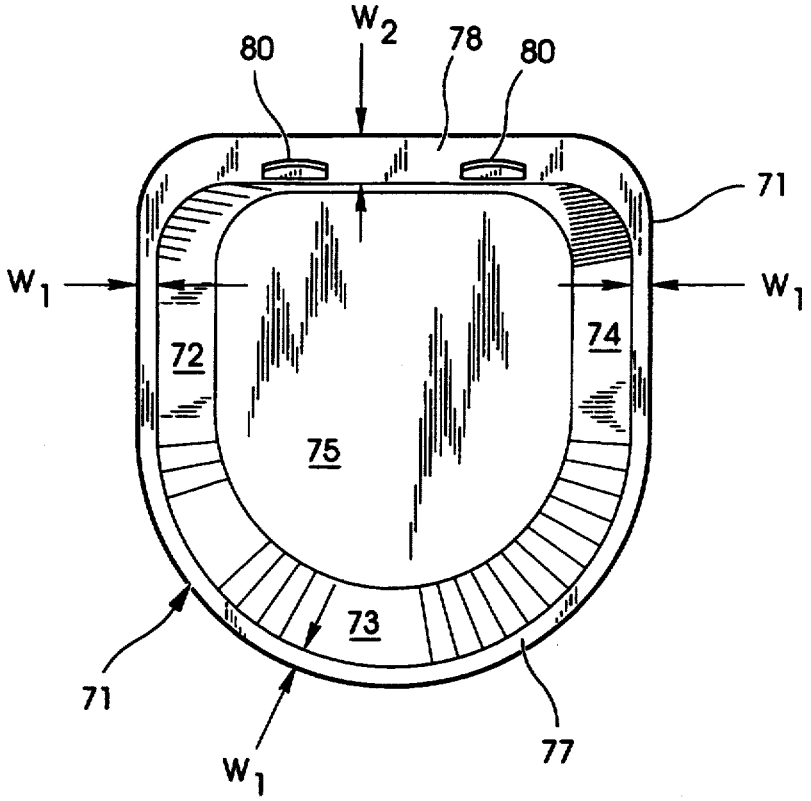
FIG. 4 is a top elevational view of the auxiliary condiment container of FIG. 3, shown without the lid.
Figure 5:
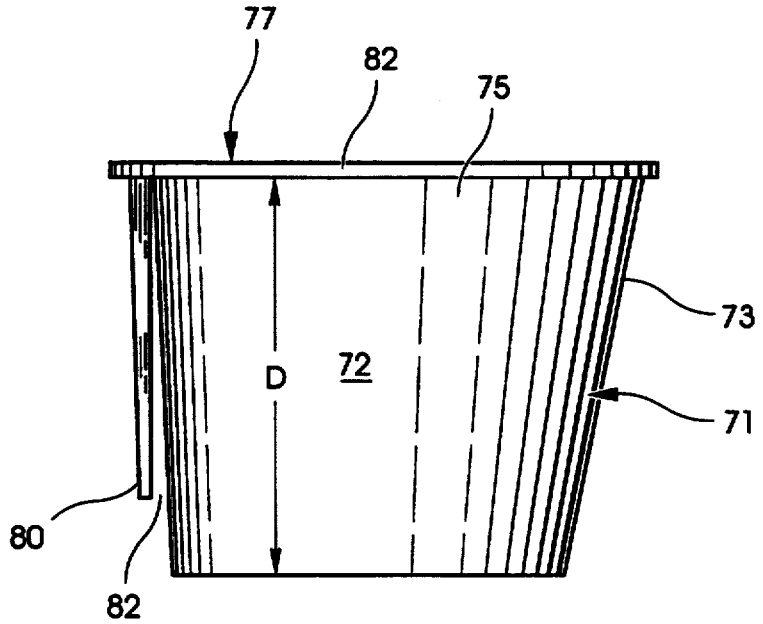
FIG. 5 is a side elevational view of the auxiliary condiment container of FIG. 3, shown without the lid.

The most preferred embodiment of the invention is depicted in FIGS. 3-5. In this embodiment a reusable auxiliary condiment container 70 includes a receptacle 71 and removable lid 72, each fanned of a washable, or dishwasher safe, material. In this embodiment the receptacle 71 and lid 72 are each molded from a thermoplastic material. The material may be clear, as depicted in the FIGS. 3-5, or may be color coded to signify the particular condiment contained therein.

The outer wall of the receptacle 71 of the condiment container 70 defines a top opening 75 surrounded by an integral flange 77. The flange 77 has a uniform width $W_1$, around most of the perimeter of opening 75 (o add strength and rigidity to the container. The flange 77 has a greater width $W_2$ at a back portion 78 of the flange that will overlap the upper edge of the food container, such as edge 21 of container 12 shown in FIG. 2. The greater width $W_2$ of the back portion 78 serves several purposes. The principal purpose is to provide adequate support for the downward prongs 80 that are generally centrally located within the width $W_2$ of the flange portion 78, allowing a sufficient gap 82 between the prongs and the receptacle to accept the food container wall 20 therein. The prongs 80 are somewhat resilient to bend as necessary to accept the food container wall but rigid enough to provide some gripping force to prevent accidental dislodgment.

A second purpose for the wider flange portion 78 is to add more rigidity to the portion of the container that supports the weight of the condiment receptacle and its contents. The greater flange width prevents buckling or twisting of the flange when the prongs are forced over the edge 21 of a food container 12.

A further important purpose of the wider flange portion 78 is to ensure an unimpeded rim 82 on flange 77 to engage the lid 72. Lid 72 is provided with an indentation 85 inside the lid within which rim 82 of flange 77 resides to clamp the lid in place. The indentation 85 is dimensioned to accept the rim thickness in a snap-fit relation to provide a virtual air-tight seal of the lid to the receptacle.

For added security, sealing strip can be applied around the junction between the lid and the receptacle. This sealing strip ensures that the contents are not tampered with after the condiment container is filled and serried. The sealing strip can be of a type known in the industry for providing tamper-proof containers.

The receptacle 71 is well suited for fabrication in an injection molding process. For example, as is evident from FIGS. 4 and 5, the side walls 72, 73 and 74 of receptacle 71 are slanted at a known draft angle for injection molding. The prongs preferably have a length greater than half the depth D of the receptacle, and preferably about ⅔ the depth of the receptacle. This length provides greater insurance against accidental dislodgement of the condiment container from the food containers.

Accordingly, it will thus be seen from the foregoing description of the invention according to these illustrative embodiments, considered with the accompanying drawings, that the present invention provides new and useful concepts of a novel and advantageous condiment holder device having and yielding desired advantages and characteristics in formation and use, and accomplishing the intended objects, including those hereinbefore pointed out and others which are inherent in the invention. Modifications and variations may be effected without departing from the scope of the novel concepts of the invention; accordingly, the invention is not limited to the specific embodiments, or form or arrangement of parts herein described or shown.

What is claimed is:

1. A combination for providing simultaneous access to discrete food pieces and a condiment for dipping the food pieces into the condiment, comprising:

a food container defining an enclosure for containing a quantity of discrete food pieces, the container having an outer wall with an upper edge defining a top opening for access to food pieces therein; and a condiment container including;

a receptacle defining a second enclosure for containing a quantity of condiment, said receptacle having a second outer wall defining a second top opening for access to condiment therein, an integral flange extending therefrom entirely around said second top opening and a number of integral prongs rigidly projecting from underneath said flange, said prongs defining a gap between said prongs and said second outer wall to receive said upper edge of said food container therein, said prongs being bendable along their length from said flange to provide a resilient clamping force along said upper edge of said food container when said upper edge is disposed in said gap; and a cover having means for removable engagement with said flange covering said second top opening.

2. The combination according to claim 1 in which said means for removable engagement of said cover to said flange includes an adhesive disposed therebetween.

3. The combination according to claim 1, wherein said flange has a width around said second opening, said width being greater at a portion of said flange integral with said prongs than at the remainder of said flange.

4. The combination according to claim 1, Wherein said cover is a lid having means for snap-fit engagement with said flange.

5. The combination according to claim 4, wherein said flange has a width around said second opening, said width being greater at a portion of said flange integral with said prongs than at the remainder of said flange.

6. The combination according to claim 5, wherein:

said number of prongs are centrally located along said greater width at said portion of said flange and said flange includes a rim therearound; and said means for snap-fit engagement of said lid includes an indentation inside said lid configured to receive said rim of said flange therein.

7. The combination according to claim 5, wherein said receptacle and said lid for said condiment container are formed of a thermoplastic.

8. The combination according to claim 1, wherein said receptacle of said condiment container has a depth and said number of prongs have a length greater than one-half said depth.

9. A condiment container to be associated with a foodstuff container for providing simultaneous access to discrete food pieces from the foodstuff container and a condiment for dipping the food pieces into the condiment, comprising:

a receptacle defining an enclosure for containing a quantity of condiment, said receptacle having an outer wall defining a top opening for access to condiment therein, an integral flange extending therefrom entirely around said top opening and a number of integral prongs rigidly projecting from underneath said flange, said prongs defining a gap between said prongs and said outer wall to receive an upper edge of a foodstuff container therein, said prongs being bendable along their length from said flange to provide a resilient clamping force against the edge of a foodstuff container disposed of said gap; and a cover having means for removable engagement with said .flange covering said top opening.

10. The condiment container according to claim 9 in which said means for removable engagement of said cover to said flange includes an adhesive disposed therebetween.

11. The condiment container according to claim 9, wherein said flange has a width around said second opening, said width being greater at a portion of said flange integral with said prongs than at the remainder of said flange.

12. The condiment container according to claim 9, wherein said cover is a lid having means for snap-fit engagement with said flange.

13. The condiment container according to claim 12, wherein said flange has a width around said second opening, said width being greater at a portion of said flange integral with said prongs than at the remainder of said flange.

14. The condiment container according to claim 13, wherein:

said number of prongs are centrally located along said greater width at said portion of said flange and said flange includes a rim therearound; and said means for snap-fit engagement of said lid includes an indentation inside said lid configured to receive said rim of said flange therein.

15. The condiment container according to claim 13, wherein said receptacle and said lid for said condiment container are formed of a thermoplastic.

16. The condiment container according to claim 9, wherein said receptacle of said condiment container has a depth and said number of prongs have a length greater than one-half said depth.

* * * * *

UNITED STATES PATENT AND TRADEMARK OFFICE

CERTIFICATE OF CORRECTION

PATENT NO. : 5,429,262

DATED : July 4, 1995

INVENTOR(S) : Edgar R. Sharkey

It is certified that error appears in the above-identified patent and that said Letters Patent is hereby corrected as shown below:

Column 3, line 57, please change "coat,her" to "container"

Column 4, line 6, please change "fanned" to "formed"

Column 4, line 15, please change "(o" to "to"

Column 4, line 48, please change "serried" to "sealed"

Signed and Sealed this

Twenty-sixth Day of December, 1995

Bruce Lehman

*Attest:*

BRUCE LEHMAN

*Attesting Officer*

*Commissioner of Patents and Trademarks*